US006544117B1

(12) United States Patent
Hardy

(10) Patent No.: US 6,544,117 B1
(45) Date of Patent: Apr. 8, 2003

(54) MOTORIZED FLOOR DIFFUSER SYSTEM

(75) Inventor: Thomas Ray Hardy, Canton, GA (US)

(73) Assignee: Gebruder Trox GmbH, Neukirkchen-vluyn (DE)

( * ) Notice: Subject to any disclaimer, the term of this patent is extended or adjusted under 35 U.S.C. 154(b) by 0 days.

(21) Appl. No.: 10/035,273

(22) Filed: Jan. 3, 2002

(51) Int. Cl.[7] ..... F24F 13/08
(52) U.S. Cl. ..... 454/290; 454/323
(58) Field of Search ..... 454/185, 186, 454/284, 289, 290, 323

(56) References Cited

U.S. PATENT DOCUMENTS 5,058,490 A * 10/1991 Sodec et al. ..... 454/289
5,180,331 A * 1/1993 Daw et al. ..... 454/187
6,083,100 A * 7/2000 Hardy et al. ..... 454/290

FOREIGN PATENT DOCUMENTS

EP 0 355 302 * 2/1990 ..... 454/290

* cited by examiner

*Primary Examiner*—Harold Joyce
(74) *Attorney, Agent, or Firm*—William B Noll

(57) ABSTRACT

An automated and adjustable air diffuser assembly for placement in a floor opening in a raised access flooring system having an air distribution plenum under the floor. The assembly comprises a fixed circular hanging frame member, a suspendable fixed frame member secured thereto, a removable grill member mounting a floating debris/liquid retention basin, and an electric motor operating a plurality of push rods to raise and lower the retention basin.

16 Claims, 4 Drawing Sheets

MOTORIZED FLOOR DIFFUSER SYSTEM

FIELD OF THE INVENTION

This invention relates to the field of floor air diffusers of the type used in raised access flooring systems, such as an office complex. More particularly, the invention is directed to a motorized adjustable airflow outlet.

BACKGROUND OF THE INVENTION

The present invention is directed to a motorized, adjustable, raised floor air diffuser that allows for the automatic control of individual outlet airflow delivery from a pressurized floor plenum system. The use of raised access floors in office complexes is rapidly gaining popularity. These systems allow power and communications wiring to be located in an easily accessible cavity below the office floor. In addition, the cavity may be used for the supply of conditioned air to the office space, eliminating most of the ductwork and insulation requirements that are inherent to overhead systems.

Underfloor air delivery systems are now becoming popular with the business community and developers due primarily to economics. Underfloor air systems, as presently known, deliver air to large zoning plenums via air terminals mounted in a floor cavity. Air is delivered to the office workers by means of high induction floor outlets that are tapped directly into the pressurized floor plenum. Additionally, such air systems allow for easy reconfiguration and add-ons for the office communications.

The air terminals or diffusers, through the use of modular flooring systems, may be placed at selected locations throughout the office complex. Typically, the air diffusers include a grill or opened cover member overriding an air chamber, where the air diffuser incorporates a manually adjustable mechanism. In U.S. Pat. No. 6,083,100, by the inventor hereof, an underfloor diffuser assembly is taught. The invention of '100 relates to an adjustable air diffuser assembly that includes first and second annular rings threadably engaging one another and secured respectively to above and below the floor, where the first annular ring includes an annular shoulder for receiving a grill assembly. The grill assembly is seated on the shoulder and is in communication with the space above the upper surface. The grill assembly further includes a centrally disposed, downwardly extending, vertically adjustable rod mounting a circular basket at its free end. The basket includes an array of through holes for delivering pressurized air from the underfloor cavity to the diffuser assembly, and means, such as a rod, connecting the basket to the grill assembly to prevent rotation of the basket. Finally, plural, radially extending, fixed vanes are provided and secured about the vertically adjustable rod to discharge air under pressure from the basket and defined sub-chamber to the space above the upper surface to impart a radial spin to the discharged air.

The typical raised floor air diffusers are manually adjustable devices. Often, such devices use a rotatable member that can close or open the damper mechanism to control the airflow from the underfloor plenum. This invention teaches an automated, motorized air diffuser system where plural air diffusers may be individually controlled through wired or wireless communication. The manner by which the present invention achieves the goals hereof will become apparent in the description which follows, especially when read in conjunction with the accompanying drawings.

SUMMARY OF THE INVENTION

This invention relates to an automated, motorized air diffuser assembly for placement in a floor opening in a raised access flooring system having an air distribution plenum under the floor. The assembly comprises a generally circular hanging frame member, to be removably secured to the floor, a suspended fixed frame member having an annular damper opening and extending from the hanging frame member, and a removable grill member. The removable grill member mounts a fixed, downwardly extending central post, a floating damper retention basin, and a light weight compression spring about the post and acting to space the retention basin from the grill member. Positioned and mounted within the suspended fixed frame member is a motor operable to raise and lower plural push rods that act against the bottom of the retention basin. As the push rods rise and act against the retention basin, all accomplished remotely by wire or wireless signal means, the retention basin begins to rise to partially or completely close off the damper opening and thus control the airflow from the underfloor plenum through the system. Concurrent with the rising retention basin the compression spring begins to compress. When it is time to lower the retention basin, the motor is reversed and, with the aid of the stored energy in the spring, the floating retention basin is lowered to further open the damper. Also, maintenance is made easy by the fact that the grill member is removable to access the retention basin where debris and liquid may accumulate over time, all without disturbance to the motor and wiring mechanism.

Accordingly, a feature of this invention is to provide a remotely activated air diffuser system, whether a plurality or an individual outlets.

A further feature of the invention hereof lies in an air diffuser system that allows removal and cleaning of debris/liquid from a retention basin without disturbance of any of the automatic control components or wiring.

Another feature of this invention is the use of modular connection that facilitates easy field connection to control wiring for the air diffuser hereof.

These and other features of the invention will become more apparent, particularly by those skilled in the art, from a reading of the following specification.

DETAILED DESCRIPTION OF PREFERRED EMBODIMENT

Figure 1:
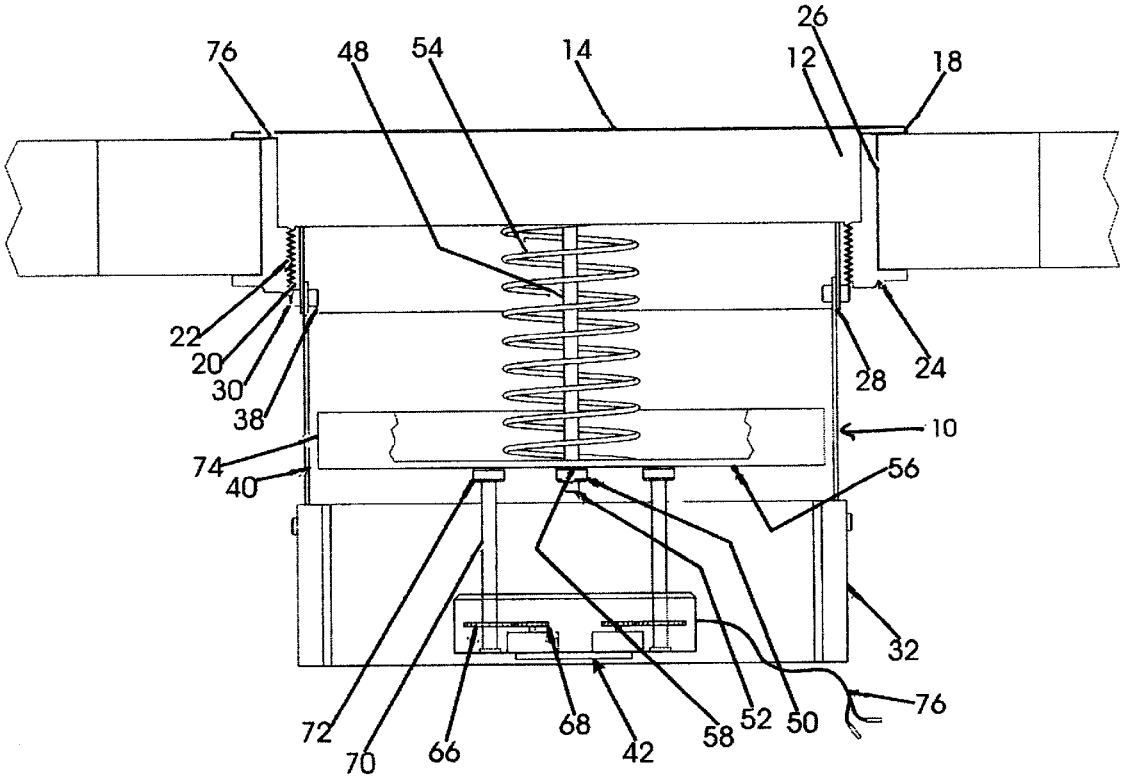
FIG. 1 is a sectional view, with parts removed, showing the automated, motorized air diffuser system according to the present invention.

The present invention is directed to an automated, motorized air diffuser mechanism for use in a raised access flooring system. The mechanism, operable through wired or wireless input signals, and intended to provide a variable volume control, will now be described with regard to the accompanying Figures, where like reference numerals represent like components or features throughout the several views.

Figure 2:
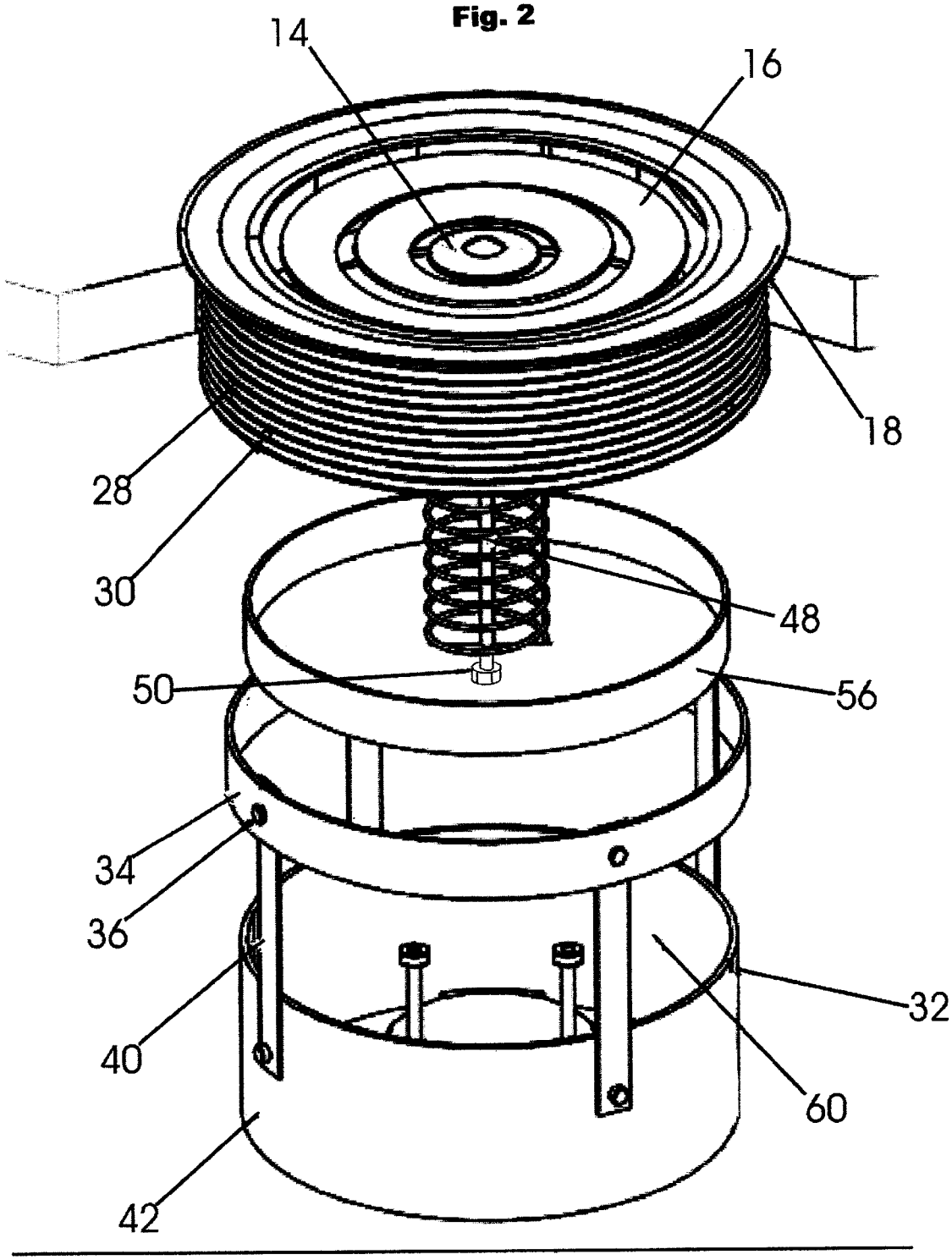
FIG. 2 is an exploded perspective view of certain components forming the air diffuser system of this invention.

Turning first to FIGS. 1 and 2, where FIG. 1 illustrates the assembled air diffuser system 10 according to the present invention, where the respective components may be of plastic or aluminum construction, the system comprises a generally circular hanging frame member 12 having a removable grill member 14 with a series of concentric openings 16, preferably transmitting the supplied conditioned air in a 360° cyclonic "swirl" discharge pattern to the above space. The frame member further features a laterally extending flange 18, such as made of an aesthetically pleasing brushed aluminum, to override the floor carpeting, as known in the art, and an axially extending body portion 20, where the body portion is externally threaded 22 to receive a comparably threaded retention ring 24. When suitably joined together, as best seen in FIG. 1, the system is properly fixed relative to the floor opening 26. The lower edge 28 of the body portion includes plural apertures 30 for engaging a suspended frame member 32.

The suspended frame member 32 comprises a first continuous annular ring 34 having a like plurality of aligned apertures 36 for receiving complementary fastening members 38 to join the continuous annular ring 34 to the plural apertures 30, thereby to fix the suspended frame member 32 relative to the body portion 20. The suspended frame member further includes plural hanger members 40 to which is joined a motor support member 42, where the motor support member 42 includes a base 44 (FIG. 3) on which are mounted a motor 46, as more fully discussed hereafter.

A central post 48, connected to the grill member 14, is suspended downwardly from the grill member, with a threaded bolt 50 at its free end 52. The central post includes a compression spring 54, and a floating damper retention basin 56, where the basin includes a central opening 58 of a size to allow the damper retention basin to slide upwardly and downwardly along the central post 48. Until moved by activation of the motor 46, the compression spring maintains the spaced relationship of the basin to the body portion 20. In the rested or relaxed position of the compression spring 54 the retention basin is generally positioned at the opening 60 between the annular ring 34 and motor support member 42. This represents the maximum opened position for the system and hence the maximum airflow through the diffuser system of this invention. It will be apparent that as the retention basin 56 is caused to moved upward, as later discussed, the opening 60 begins to close or be reduced to control the airflow as desired. That is, the movable retention basin can reduce the vertical dimension of the opening 60 through which conditioned air is supplied to the diffuser.

Figure 3:
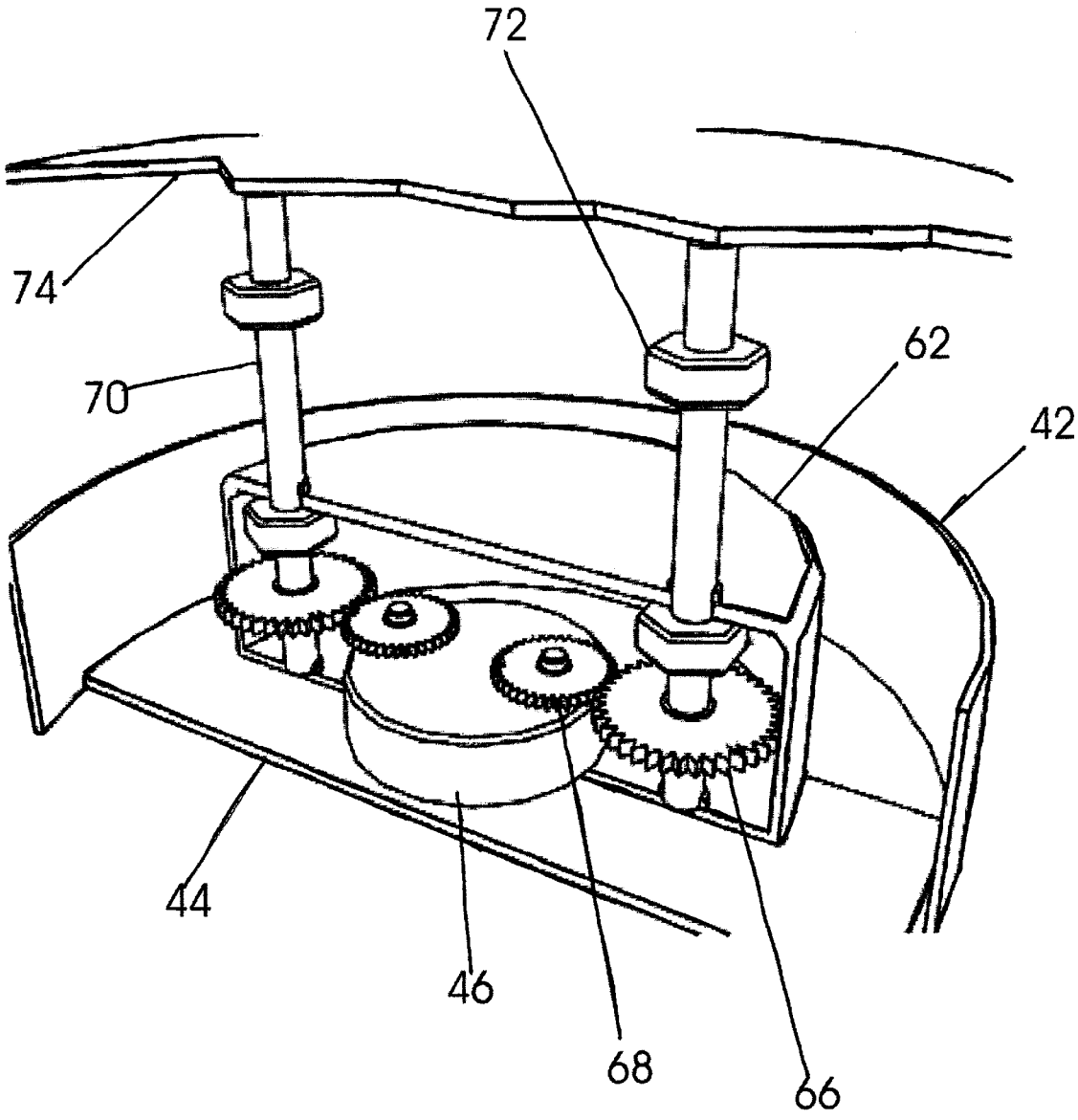
FIG. 3 is a sectional view illustrating the motorized mechanism for automatically operating the air diffuser system hereof.
Figure 4:
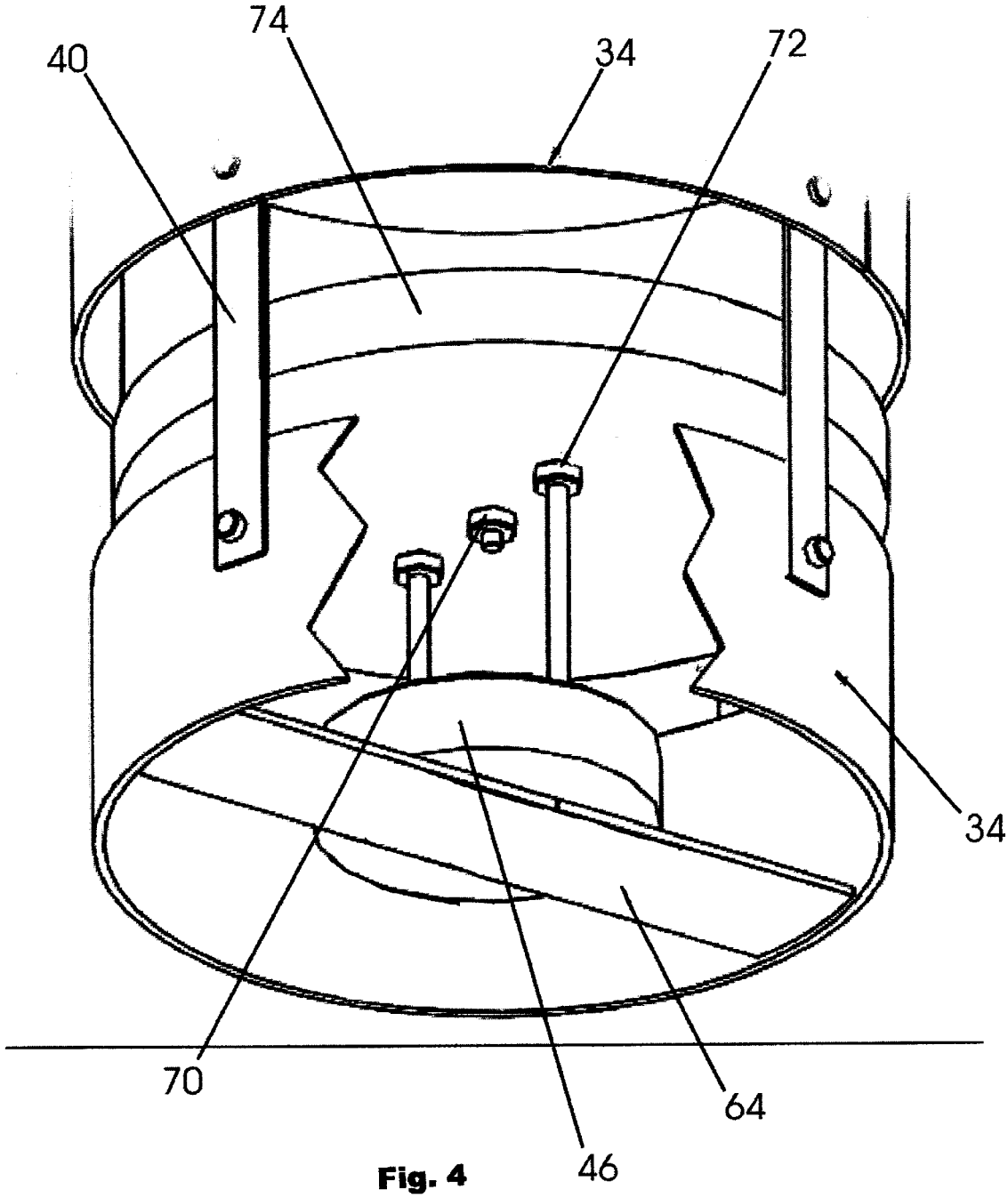
FIG. 4 is a bottom perspective view showing the suspended support frame and motor support frame of this invention.

Mounted within the motor support member 42 is a motor 46, see FIGS. 3 and 4. The motor 46 includes a generally closed housing 62 secured to a motor support frame 64 shown fully in FIG. 3. The motor 46 preferably comprises a 24VAC electric actuator to vertically position the airflow retention basin in response to a control signal, whether transmitted by wire or wireless means. The electric actuator includes plural reversible gears 66 operable by planetary gears 68 to operate threaded push rods 70, where the distal ends of said rods each mount a cap member 72 that abuts against the bottom surface 74 of the retention basin 56. As the motor 46 is activated via connectors 76 to an electric source, not shown, the threaded push rods 70 push the retention basin to a more upward or closed position to control airflow as desired. A reverse operation of the motor 46 will lower the respective push rods and the stored energy of the compression spring 54 will lower the retention basin and maintain its contact with the push rod cap members 72.

Since a feature of this invention is the ability to clean any debris/liquid from the floating retention basin without disturbance of the automatic control components or wiring, the grill member 14, nesting on the shoulder 76 of the circular frame housing 12, see FIG. 1, the grill member may be lifted from contact with laterally extending flange 18. By lifting the grill member, and the attached central post 48, the damper retention basin 56 is easily withdrawn from the assembly. If necessary, the damper retention basin may be removed from the central post 48 by first removing the threaded bolt 50 and separating the components. This allows for easy cleaning of the floating retention basin. Once the floating retention basin is slid onto the post, and the threaded bolt threaded onto the post, the grill and attached components may be repositioned within the suspended frame member.

Another feature hereof is the provision of using modular connections for the wiring connections to facilitate easy field connection to control wiring.

It is recognized that changes, variations and modifications may be made to the automated, motorized air diffuser system of this invention, particularly by those skilled in the art, without departing from the spirit and scope thereof. Accordingly, no limitation is intended to be impoised thereon except as set forth in the following claims.

What is claimed is:

1. In combination with a raised floor access system, where the floor consists of an upper surface and a lower surface, a generally circular opening within said floor for receiving an air diffuser assembly in communication with an underfloor air distribution plenum, an automatic and adjustable air diffuser assembly comprising:

a.) a generally circular hanging frame member having an annular body portion for seating within said floor opening, where said body portion is externally threaded, an outwardly directed flange to overlie said upper floor surface;

b.) a threaded retention ring for threadably engaging said externally threaded body portion to lie against said lower floor surface and fix said hanging frame member to said floor;

c.) a removable and open grill member for seating on said circular hanging member, said grill member mounting a downwardly extended post slidably receiving a floating damper retention basin, and a light weight compression spring about said post in contact with said retention basin; and, d.) a suspended fixed frame member, comparably sized to said body portion, comprising a first annular ring for mounting to said body portion, and a motor support member spaced axially from said annular ring by plural hanger members, where said motor support member mounts a reversible motor for raising and lowering a plurality of push rods, and said push rods, in contact with said retention basin, act to raise and lower said retention basin, whereby to selectively position said retention basin within said fixed frame member to control airflow from said plenum through said grill member.

2. The combination according to claim 1, wherein said annular ring and said motor support member define an annular damper opening, and said floating damper retention basin is movable relative to said damper opening.

3. The combination according to claim 1, wherein said retention basin is generally circular in configuration with a central opening for sliding engagement with said post.

4. The combination according to claim 1, wherein said fixed frame member is fastened to said annular body portion.

5. The combination according to claim 1, wherein said removable and open grill member is seated on said generally circular hanging frame member, said grill member having an upper surface planarly aligned with said outwardly directed flange.

6. The combination according to claim 1, wherein said reversible motor is housed within a closed housing, and includes a modular connection to a remote signal controlling means.

7. The combination according to claim 1, wherein said post has a threaded free end receiving a complementary threaded bolt for the easy removal of said retention basin for cleaning.

8. The combination according to claim 1, wherein said push rods have a free end mounting a cap for pushing against said retention basin.

9. An automatic and adjustable air diffuser assembly for use with a raised floor air distribution system, said assembly comprising:

a.) a generally circular hanging frame member having an annular body portion for seating within a floor opening, in communication with said air distribution system, said body portion is externally threaded, and includes an outwardly directed flange;

b.) a threaded retention ring for threadably engaging said externally threaded body portion to fix said hanging frame member relative to said air distribution system;

c.) a removable and open grill member for seating on said circular hanging member, said grill member mounting a downwardly extended post slidably receiving a floating damper retention basin, and a light weight compression spring about said post in contact with said retention base; and, d.) a suspended fixed frame member, comparably sized to said body portion, comprising a first annular ring for mounting to said body portion, and a motor support member spaced axially from said annular ring by plural hanger members, where said motor support member mounts a reversible motor for raising and lowering a plurality of push rods, and said push rods, in contact with said retention basin, act to raise and lower said retention basin, whereby to selectively position said retention basin within said fixed frame member to control airflow from said air distribution system through said grill member.

10. The automatic and adjustable air diffuser assembly according to claim 9, wherein said annular ring and said motor support member define an annular damper opening, and said floating damper retention basin is movable relative to said damper opening.

11. The automatic and adjustable air diffuser assembly according to claim 9, wherein said retention basin is generally circular in configuration with a central opening for sliding engagement with said post.

12. The automatic and adjustable air diffuser assembly according to claim 9, wherein said fixed frame member is fastened to said annular body portion.

13. The automatic and adjustable air diffuser assembly according to claim 9, wherein said removable and open grill member is seated on said generally circular hanging frame member, said grill member having an upper surface planarly aligned with said outwardly directed flange.

14. The automatic and adjustable air diffuser assembly according to claim 9, wherein said reversible motor is housed within a closed housing, and includes a modular connection to a remote signal controlling means.

15. The automatic and adustable air diffuser assembly according to claim 9, wherein said post has a threaded free end receiving a complementary threaded bolt for the easy removal of said retention basin for cleaning.

16. The automatic and adustable air diffuser assembly according to claim 9, wherein said push rods have a free end mounting a cap for pushing against said retention basin.

* * * * *